US005382780A

United States Patent [19]

Carmen

[11] Patent Number: 5,382,780

[45] Date of Patent: Jan. 17, 1995

[54] PORTABLE TIME METERING DEVICE

[75] Inventor: Ralph H. Carmen, Merritt Island, Fla.

[73] Assignee: Duncan Industries Parking Control Systems Corp., Harrison, Ark.

[21] Appl. No.: 130,587

[22] Filed: Oct. 1, 1993

[51] Int. Cl.[6] ..... G07B 15/02

[52] U.S. Cl. ..... 235/384; 235/382; 235/382.5; 235/492

[58] Field of Search ..... 235/382, 382.5, 384, 235/492

[56] References Cited

U.S. PATENT DOCUMENTS

| | | | |
|---|---|---|---|
| 3,174,056 | 3/1965 | Leavitt et al. | 307/88.5 |
| 3,299,424 | 1/1967 | Vinding | 343/6.5 |
| 3,440,633 | 4/1969 | Vinding | 340/258 |
| 3,740,742 | 6/1973 | Thompson et al. | 340/280 |
| 3,810,172 | 5/1974 | Burpee et al. | 343/5 PD |
| 4,023,167 | 5/1977 | Wahlstrom | 343/6.55 SS |
| 4,196,418 | 4/1980 | Kip et al. | 340/152 T |
| 4,476,459 | 10/1984 | Cooper et al. | 340/572 |
| 4,481,428 | 11/1984 | Charlot, Jr. | 307/219.1 |
| 4,517,563 | 5/1985 | Diamant | 340/825.54 |
| 4,531,117 | 7/1985 | Nourse et al. | 340/572 |
| 4,572,976 | 2/1986 | Fockens | 307/524 |
| 4,605,844 | 8/1986 | Haggan | 235/380 |
| 4,630,044 | 12/1986 | Polzer | 340/825.72 |
| 4,654,641 | 3/1987 | Ferguson et al. | 340/572 |
| 4,667,185 | 5/1987 | Nourse et al. | 340/572 |
| 4,717,815 | 1/1988 | Tomer | 235/378 |
| 4,758,718 | 7/1988 | Fujisaki et al. | 235/487 |
| 4,797,659 | 1/1989 | Larsen | 340/572 |
| 4,814,595 | 3/1989 | Gilboa | 235/492 |
| 4,857,893 | 8/1989 | Carroll | 340/572 |
| 4,893,118 | 1/1990 | Lewiner et al. | 340/825.54 |
| 4,955,038 | 9/1990 | Lee et al. | 375/35 |
| 5,019,813 | 5/1991 | Kip et al. | 340/825.54 |
| 5,036,308 | 7/1991 | Fockens | 340/572 |
| 5,103,222 | 4/1992 | Hogen Esch et al. | 340/825.54 |
| 5,144,553 | 9/1992 | Hassett et al. | 235/384 |
| 5,153,583 | 10/1992 | Murdoch | 340/825.54 |
| 5,218,343 | 6/1993 | Stobbe et al. | 340/572 |

FOREIGN PATENT DOCUMENTS

| | | |
|---|---|---|
| 0131440 | 1/1985 | European Pat. Off. . |
| 0157095 | 10/1985 | European Pat. Off. . |
| 0242906 | 10/1987 | European Pat. Off. . |
| 8203849 | 5/1983 | Netherlands . |

*Primary Examiner*—Harold Pitts
*Attorney, Agent, or Firm*—Rockey, Rifkin & Ryther

[57] ABSTRACT

A portable time metering device particularly adaptable as an in-car parking meter for parking in a plurality of zones comprises a plurality of bank registers, each bank register having stored therein information representing a monetary value and each of the plurality of zones corresponding to one bank register. The device selectively determines whether a sufficient monetary value is stored in a corresponding bank register of a selected zone to allow parking in the zone. The device further determines a total amount of time parked in a selected zone if parking is allowed. The total amount of time is then used to deduct an amount from the monetary value of the corresponding bank. The device also includes a communication component for transmitting and receiving data.

20 Claims, 7 Drawing Sheets

FIG. 6(a)

140

141

| VALUE | |
|---|---|
| 0 | 0 |
| 1 | 1 PENNY |
| 2 | 2 PENNIES |
| ---------- | |
| 15 | 50 PENNIES |

142

| TIME LIMIT | |
|---|---|
| 0 | :15 |
| 1 | :24 |
| 2 | :30 |
| ---------- | |
| 8 | 6:00 |
| ---------- | |
| 15 | 48:00 |

143

| BREAK POINT | |
|---|---|
| 0 | :15 |
| 1 | :30 |
| 2 | :45 |
| ---------- | |
| 7 | 2:00 |
| ---------- | |
| 15 | 4:00 |

FIG. 6(b)

144

ZONE DATA

| ZONE | VALUE | BANK# | BREAK POINT | TIME LIMIT | RATE 0 | RATE 1 |
|---|---|---|---|---|---|---|
| 1 | 5 | 0 | 7 | 6 | 72 SEC. | 36 SEC. |
| ---------- | | | | | | |
| 6 | 1 | 1 | 7 | 8 | 72 SEC. | 36 SEC. |
| ---------- | | | | | | |
| 20 | 0 | 3 | 7 | 0 | 72 SEC. | 36 SEC. |

PORTABLE TIME METERING DEVICE

BACKGROUND OF THE INVENTION

This invention relates to a portable time metering device particularly useful as an in-car parking meter. More particularly, the invention relates to an in-car parking meter which is conveniently displayed from a rearview mirror. The parking meter monitors the amount of time an automobile of a user is parked in a particular parking zone and ultimately deducts a corresponding amount of funds based on stored information from a bank register contained in the in-car parking meter.

While the invention is particularly directed to the art of metering devices and more particularly directed to the art of in-car parking meters, and will thus be described with specific reference thereto, it will be appreciated that the invention may have usefulness in other fields and applications.

The demand for in-car parking meters is increasing in view of the fact that in-car parking meter systems can be used in lieu of traditional parking meters. Municipalities and other institutions, such as universities, may utilize in-car parking meter systems to more efficiently and economically administer their respective parking programs. Use of an in-car parking meter system obviates the need for conventional parking meters and collection personnel.

A general example of a known manner in which to administer an in-car parking meter system may be to provide users with an in-car parking meter and allow the users to prepurchase increments of time from an administering authority, such as a governmental agency or convenience store. For example, a user may place one hundred U.S. dollars of parking time on a parking meter by paying one hundred dollars in cash to the administering authority. Use of the in-car parking meter device results in deduction from the prepurchased amount of parking time in accordance with the amount of time parked in particular parking zones. The parking zones and rates are predetermined and specified by the administering authority.

More particularly, as shown in FIG. 10, parking time is prepurchased by a user from an administering authority (step A). When the user wishes to use the device to meter parking time, he selects the proper zone for the desired parking area (step B) and activates the device (step C) to initiate a timing period. This timing period can be a predetermined period or an open ended amount. For example, different areas of a city, or different locations on a college campus will be prioritized and assigned different parking rates (e.g., 50 cents per hour for one area/region and 75 cents per hour for a different area/region). After selecting the zone, the user then positions the device in a location in the automobile so that the device can be conveniently viewed by a parking attendant to verify that the automobile is legally parked (step D). Upon return to the automobile, the user deactivates the device (step E).

Although present in-car parking meter devices are an advance over traditional pole-type meters, a number of convenient features are lacking. One such desirable feature is the ability to conveniently deduct money from a number of separate storage banks. Such ability would make it possible to prepay funds for parking to a number of different administering authorities in different municipalities yet maintain accounting and auditing efficiency. Other features lacking include communication capability with other devices for loading data, auditing and verification, a sufficiently large number of available parking zones each having a rate/value, convenient computation to predetermine if a car can be parked in a certain zone based on the amount of funds stored in a corresponding bank, and improved flexibility.

For instance, U.S. Pat. No. 4,717,815 to Tomer discloses a time metering device particularly useful as a parking card. Such time metering device includes a time storage device for storing total prepurchased time, a time measuring device, a time selector key means for manually selecting a predetermined time interval, and a predetermined interval storage device for storing data representing the predetermined time interval selected.

The parking meter device of the Tomer patent, however, does not contain a plurality of banks storing prepaid funds. Moreover, the Tomer patent only stores total prepurchased time, not funds at all. Nor does such device include any means for predetermining whether a car can be parked in a particular zone based on the amount of funds stored in the corresponding bank of that zone. It is merely a simple countdown device. Further, the device of the Tomer patent does not provide communication capability. These attributes and others are desired for the reasons noted above.

SUMMARY OF THE INVENTION

The principal object of the present invention is to provide an improved portable time metering device particularly useful as an in-car parking meter.

A further object of the present invention is to provide an in-car parking meter having a plurality of different banks, thus allowing prepaying of funds to a plurality of different administering authorities.

A still further object of the present invention is to provide an in-car parking meter having a capability of determining whether a user can park in a particular zone based on an amount of funds stored in its bank for that particular zone.

A still further object of the present invention is to provide an in-car parking meter having a communication capability for loading, auditing, and verification.

A still further object of the invention is to provide a control procedure for the device which consumes reduced amounts of power.

According to the invention, there is provided an in-car parking meter comprising a microcomputer, an LCD display, and a communication transceiver. The microcomputer includes a plurality of bank registers for storing monetary values related to the prepayment of funds for parking time to a plurality of sources. The microcomputer also facilitates selection of a parking zone, timing of the amount of time parked, and deduction of an appropriate amount of funds from the corresponding bank register in accordance with the amount of time parked and other pertinent information stored in the parking meter.

According to another aspect of the invention, the microcomputer includes means for determining if a user can park in a selected zone based on the prepaid funds stored in the appropriate bank register for such zone.

According to another aspect of the invention, the LCD display includes means for selectively displaying information such as the contents of a bank register, the maximum time for the selected zone, the amount of time allowed based on the amount of prepaid funds stored in the corresponding bank register, the time remaining in the selected zone and the selected zone designation.

According to another aspect of the invention, the communication transceiver includes means for receiving signals to load data into, load monetary values into, and audit the in-car parking meter. The transceiver can also be used to verify the validity of the parking device or use thereof.

According to another aspect of the invention, the device is provided with a control procedure which requires low power, thus reducing power consumption.

Further scope of the applicability and advantages of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention includes the construction, arrangement, and combination, of the various parts of the device, whereby the objects contemplated are attained as hereinafter more fully set forth, specifically pointed out in the claims, and illustrated in the accompanying drawings in which:

FIG. 6(*a*) is a more detailed view of the table storage shown in FIG. 5;

FIG. 6(*b*) is a more detailed view of the zone data storage shown in FIG. 5;

DETAILED DESCRIPTION OF THE PREFERRED EMBODIMENTS

Figure 1:
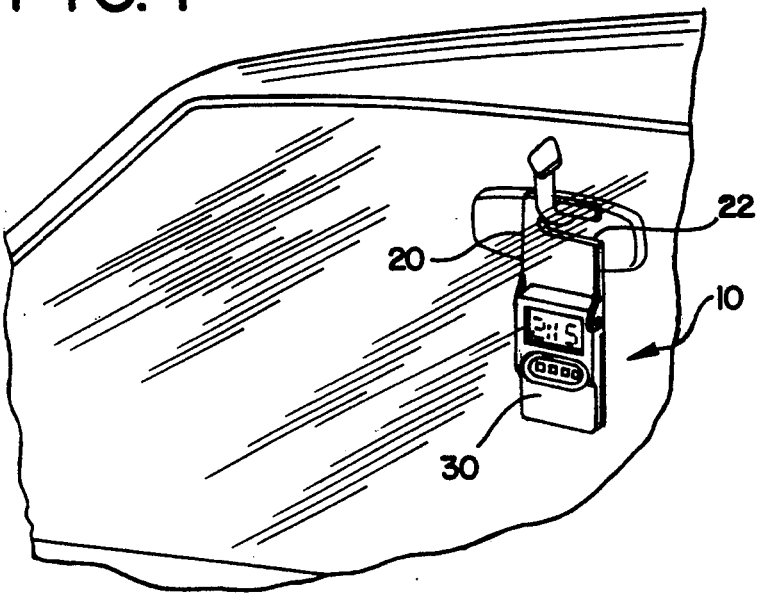
FIG. 1 is a perspective view of the time metering device as displayed from a rearview mirror of an automobile during use.
Figure 2:
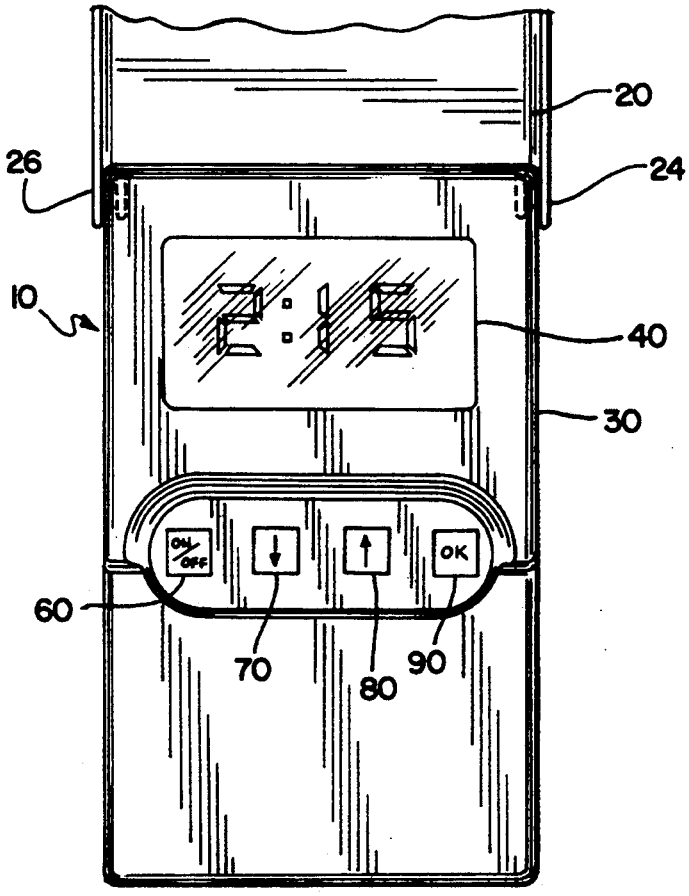
FIG. 2 is a front elevational view of the time metering device of FIG. 1.

Referring now to the drawings wherein the showings are for purposes of illustrating the preferred embodiments of the invention only and not for purposes of limiting same, FIG. 1 shows a portable time metering device, or in-car parking meter, 10 displayed in the windshield of an automobile supported by a rearview mirror post. FIG. 2 provides a more detailed view of the device 10. While attachment of the device 10 to a rearview mirror is preferred, any suitable arrangement is acceptable as long as the display 40 is conveniently viewable from outside the automobile.

Referring to both FIGS. 1 and 2, wherein, as in all of the drawings, like numerals have been used to designate identical elements, the subject new device 10 includes an upper portion 20 and a lower portion 30. The upper portion 20 includes a recess 22 conveniently disposed therein to facilitate attachment of the device 10 to a rearview mirror or the like. Additionally, the upper portion 20 is connected to the lower portion 30 by pivotal attachment means 24, 26. The pivotal attachment means 24, 26 allows the upper portion 20 to pivot with respect to the lower portion 30 to substantially cover and protect the lower portion 30 when the device 10 is not in use.

The lower portion 30 includes a display 40 and a control panel 50. The display 40 is preferably an LCD display used to display information such as parking zone designations, time limits, and security and verification information. Of course, other types of displays can be advantageously used without departing from the scope and intent of the subject invention.

The control panel 50 includes an on/off key 60, a decrement key 70, an increment key 80, and a confirm key 90. The on/off key 60 is used to activate and deactivate the display 40. The increment key 70 and decrement key 80 provide for incrementing and decrementing of displayed data such as parking zone designations and time limits. The confirm key 90 facilitates confirming or entering displayed data. While the foregoing configuration of keys is preferred, it is recognized that any number of keys or arrangements thereof may be suitable.

Figure 3:
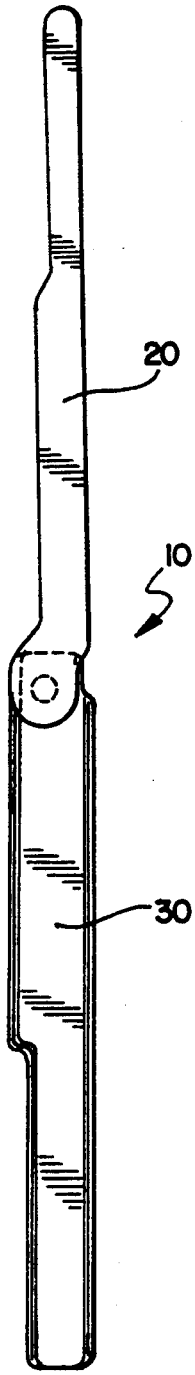
FIG. 3 is a side elevational view of the time metering device of FIG. 1.

As best illustrated in FIG. 3, the device 10 is relatively thin and refined, allowing for convenient handling thereof. Again, other shapes and housing configurations can be used but this arrangement is preferred for the above-noted reasons.

Figure 4:
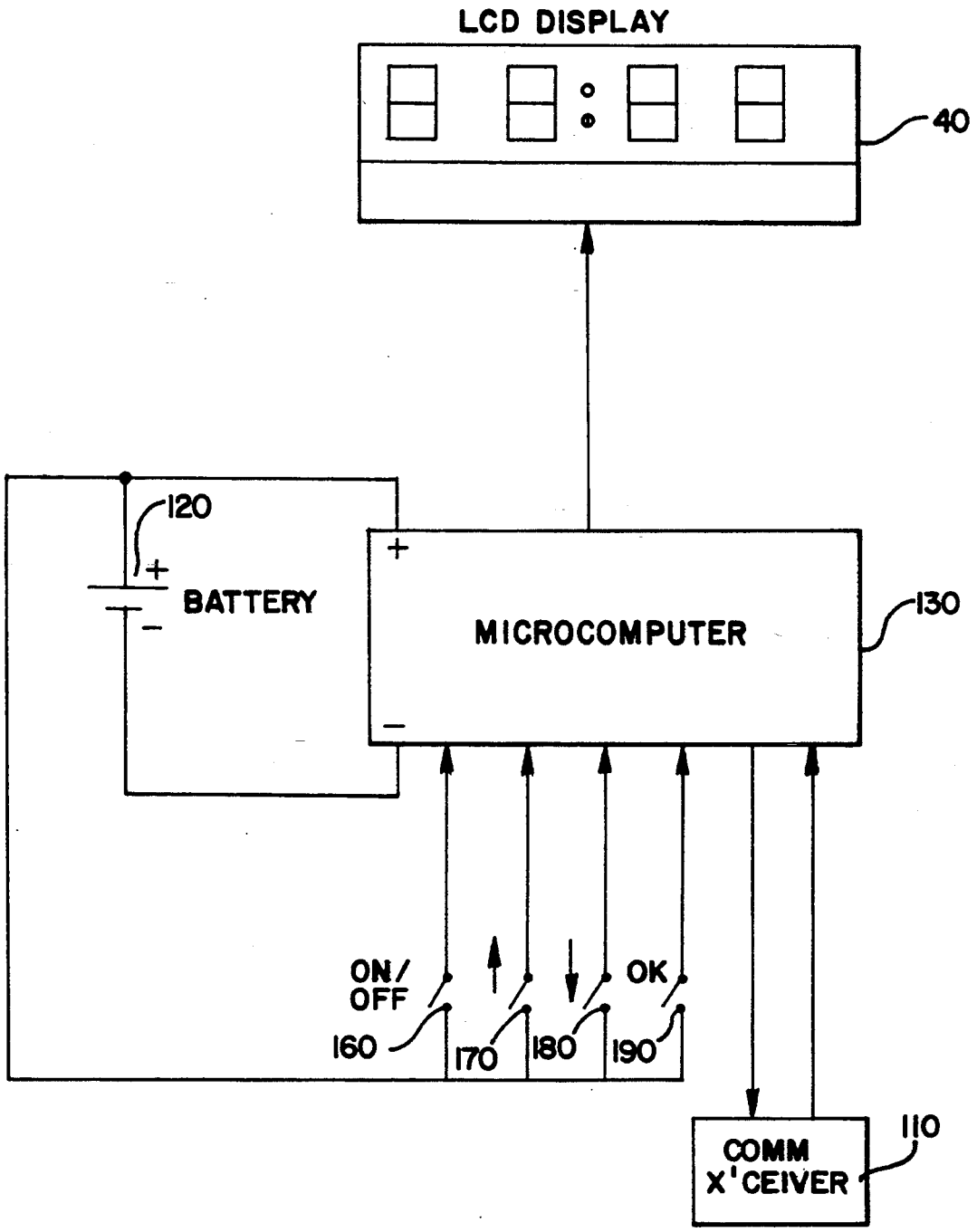
FIG. 4 is a schematic representation of a preferred embodiment of the time metering device of FIG. 1.

FIG. 4 is a schematic representation of the circuitry of the device 10. As shown, the device 10 includes, in addition to the display 40, a communication transceiver 110, a power supply 120 of any suitable type that powers a microcomputer 130, and switches 160, 170, 180, 190 corresponding to the keys 60, 70, 80, and 90, respectively.

The communication transceiver 110 is connected to the microcomputer 130. The transceiver 110 is used to transmit and receive information necessary to load data into the microcomputer 130, load data representing prepaid funds into bank registers (0–3) 131–134 (more particularly described with reference to FIG. 5), audit the microcomputer 130, and perform verification procedures. The ability to load data into and audit the microcomputer 130 via the communication transceiver 110 provide the device 10 with the characteristic of reusability resulting in improved flexibility. Such characteristic allows an administering authority to reduce its costs in that a new device 10 need not be issued for each prepayment of funds by a user or each change in parking rates and/or zones. Users need only have an existing device 10 reloaded or audited to change or manipulate data stored therein.

It is appreciated, however, that the communication transceiver 110, and, consequently, reusability, may be features not desired in certain instances. In that case, it is foreseen that a similar disposable device 10 may be developed without departing from the scope and intent of the present invention.

The verification procedures may include an exchange of information, such as identification codes for the devices and/or users, between the device 10 and another device via the communication transceiver 110 to assure that the device 10 is a genuine device being operated in a valid, or legal, manner. Such verification significantly reduces the risk of proliferation of counterfeit devices. It is appreciated that a variety of types of verification procedures may be performed which fall within the scope of the invention.

The communication transceiver 110 may be of any type known to those skilled in the art as long as data reception and transmission is accommodated. In the preferred embodiment, the transceiver is a non-contact, low power communication transceiver so that loading (or reloading), auditing, and verification may be accomplished in a serial fashion 1) from a remote device, and 2) with reduced power consumption.

Figure 5:
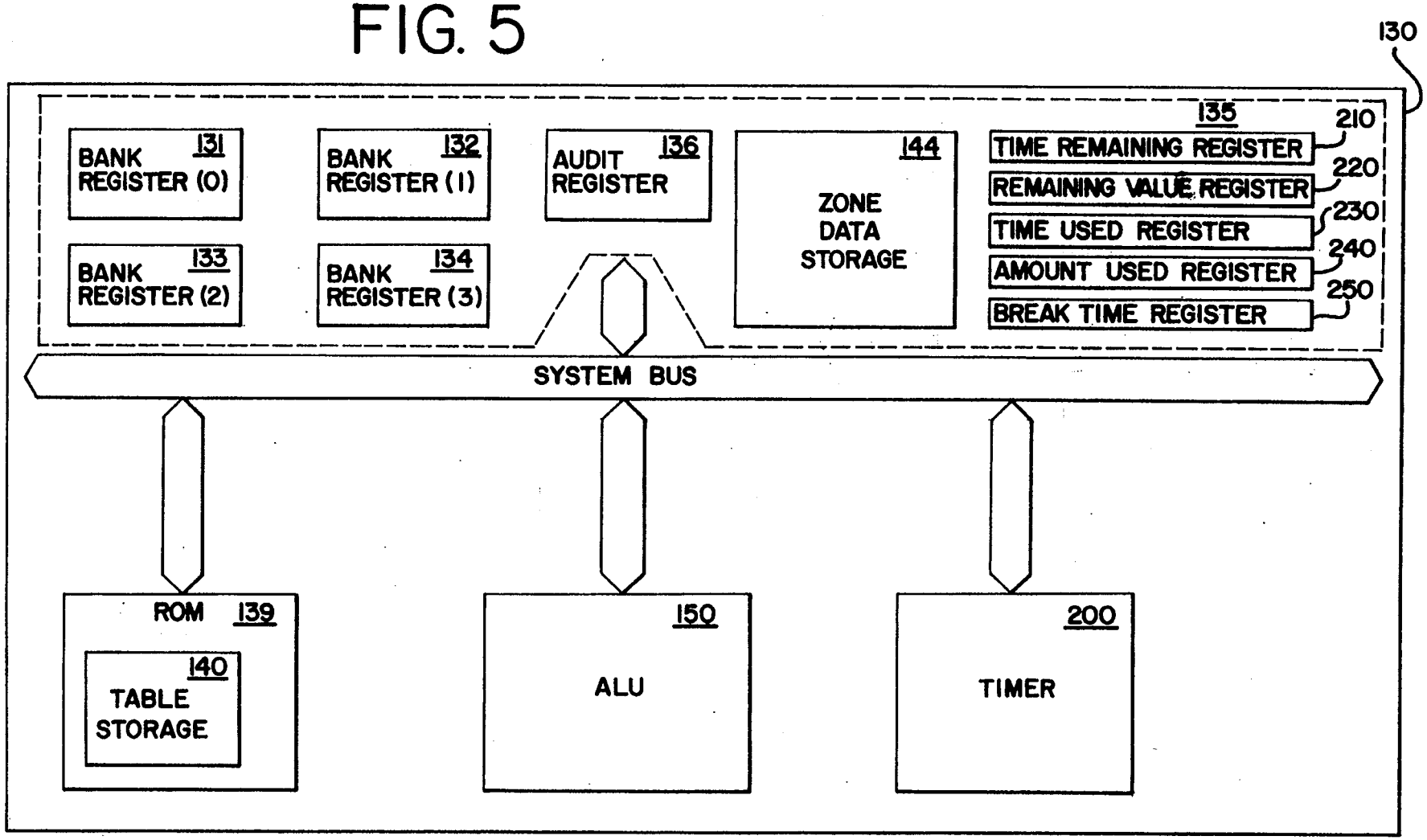
FIG. 5 is a detailed illustration of the microcomputer shown in FIG. 4.

FIG. 5 shows a more detailed view of the microcomputer 130. The microcomputer 130 used is preferably an LC 5862 manufactured by Sanyo. However, any suitable microcomputer may be used.

It should be noted that only those portions of the microcomputer 130 relevant to the following discussion are shown and described. It is recognized that other portions, well known in the art, are also included therein.

As can be seen, the microcomputer 130 has incorporated therein plural bank registers (0–3) 131–134 for storing respective monetary values. Four registers are shown and described but this invention is equally applicable to other plural bank register arrangements. It is to be appreciated that bank registers (0–3) 131–134 are preferably incorporated in a random access memory, or RAM, 135 (conceptually represented by a broken line) of the microcomputer 130. However, any provision of registers known in the art will suffice. The bank registers (0–3) 131–134 are conceptually depicted in FIG. 5 as separate elements for ease of reference only.

Each monetary value respectively stored in the bank registers (0–3) 131–134 represents a cash amount previously tendered by the user to an administering authority to effectively purchase parking time. Preferably, each of the bank registers (0–3) 131–134 corresponds to a separate administering authority.

For example, the bank register (0) 131 may have a monetary value stored therein representing $100 of prepaid funds for parking tendered to Arlington, Va. The bank register (1) 132 may have a value stored therein representing $50 of prepaid funds for parking tendered to Washington, D.C. Similarly, the bank registers (2–3) 133–134 may have data representing other monetary values. Funds are ultimately deducted from the bank registers (0–3) 131–134 as necessary in accordance with time parked in a manner subsequently to be described.

The microcomputer 130 further incorporates a single audit register 136. The audit register 136 is used to maintain a cumulative total of deductions from all of the bank registers (0–3) 131–134. Accordingly, the audit register 136 acts as a redundant balance check system when questions arise regarding representative values stored in the bank register (0–3) 131–134. It is preferred that one audit register 136 be provided for a plurality of bank registers (0–3) 131–134 to allow for convenient accounting when funds are prepaid to a plurality of administering authorities. However, it is to be appreciated that a plurality of audit registers may be used along with a single master bank. In such a configuration, administering authorities would rely on audit register amounts to assess parking charges. This type of assessment may occur on a retroactive basis, as well as on a prospective basis using a prepayment arrangement.

The microcomputer 130 further includes a table storage 140. As shown in FIG. 6(*a*), the table storage 140 has storage areas allocated to a variety of data tables, or look-up tables, 141–143, each containing pertinent information. The table storage 140 is preferably incorporated in a read only memory, or ROM, 139 (shown in FIG. 5). However, it is well appreciated that any other suitable memory type such as RAM, EPROM . . . etc. may alternatively be used.

In each of the tables 141–143, sixteen (16) data items are stored and indexed by the designators numbered 0 through 15. Designators, instead of actual data, are then stored in a zone data storage 144 (shown in FIGS. 5 and 6(*b*)). It is appreciated that any number of data items may be stored in any of the respective tables.

As illustrated, a value table 141 is provided. The value table 141 stores information representing an amount of funds deducted for each time increment designated by RATE 0 and RATE 1 (to be described hereinafter). For example, in U.S. currency, the value table 141 stores information representing an amount of pennies per value increment. This information can be used to ultimately determine the amount of funds charged per hour for a particular zone.

Time limit table 142 stores information to determine the maximum time limit for each of the respective parking zones. Likewise, breakpoint table 143 contains data used to determine a breakpoint between a first interval of the maximum time limit and a second interval of the maximum time limit of each of the respective zones. While not shown, it is appreciated that a breakpoint of zero could be designated to accommodate zones utilizing only one time interval.

Referring now to both FIGS. 6(*a*) and (*b*), the zone data storage 144 is a two-dimensional table storing a plurality of information items for each zone. In particular, a value corresponding to an entry in value table 141, a time limit corresponding to an entry in time limit table 142, and a break point corresponding to an entry in break point table 143 are provided for each zone. With this arrangement, in order to determine a value, a time limit or a break point for a particular zone, the zone data storage 144 is referenced to determine a designator for the value, time limit, or break point. The appropriate table 141–143 is then accessed using the designator from storage 144 to determine the actual data to be used for calculation.

The zone data storage 144 is preferably included in RAM 135 so that the information stored therein can be altered, thus providing rate customization for the zones in accord with the desires of the administering authority. If rate customization and the resulting flexibility is not desired, storage 144 could be included in ROM or the like.

Additionally, information correlating the zones to a bank register (0–3) 131–134 and rate information, i.e., number of seconds for each value increment of parking time corresponding to value inn table 141, are included in the zone data storage 144. As shown, since any one zone may have two rates, a so-called split rate structure, zone data storage 144 stores a RATE 0 for the first interval of the maximum time limit and a RATE 1 for the second interval of the maximum time limit. RATE 0 and RATE 1 represent time increments and, preferably, are represented by the units of seconds. However, any conventional time units may be used.

For example, parking zone 6 has a value increment equal to one (1) penny for each time increment of RATE 0 or RATE 1, respectively. The value of one (1) is determined by using the designator in the value column of storage 144 corresponding to zone 6 and referencing the value table 141. Similarly, it is determined that zone 6 has a maximum time limit of six hours (6:00) and a breakpoint of two hours (2:00) by referencing the tables 142 and 143, respectively. Referring directly to the zone data storage 144, it is further determined that zone 6 corresponds to the bank register (1) 132 and that the respective time increments for RATE 0 and RATE 1 are 72 seconds and 36 seconds, respectively.

Using the value and respective data for RATE 0 and RATE 1, the hourly charges for zone 6 can be calculated using equations (1) and (2) below.

$$3600\,\frac{\text{seconds}}{\text{hour}} \times \frac{1}{\text{RATE 0}} \times \text{VALUE} = \tag{1}$$

$$3600\,\frac{\text{seconds}}{\text{hour}} \times \frac{1}{72\text{ seconds}} \times 1\text{ penny} =$$

$$50\,\frac{\text{pennies}}{\text{hour}} = \$\,.50/\text{hr.}$$

$$3600\,\frac{\text{seconds}}{\text{hour}} \times \frac{1}{\text{RATE 1}} \times \text{VALUE} = \tag{2}$$

$$3600\,\frac{\text{seconds}}{\text{hour}} \times \frac{1}{36\text{ seconds}} \times 1\text{ penny} =$$

$$100\,\frac{\text{pennies}}{\text{hour}} = \$\,1.00/\text{hr.}$$

Therefore, in zone 6, for the first two hours of parking, i.e., up to the breakpoint, the charge is $0.50/hr. For the last four hours of the six hour maximum, the charge is $1.00/hr.

The aforenoted storage scheme illustrates both indirect accessing of data, i.e., value, time limit, and breakpoint, and direct accessing of data, i.e., correlation to a bank register, RATE 0, RATE 1. It is appreciated, however, that any combination of direct/indirect accessing of data may be used including direct accessing, exclusively, or indirect accessing, exclusively. A suitable arrangement of tables would necessarily result from any variation of the preferred embodiment.

Referring once again to FIG. 5, the microcomputer 130 further includes a timer 200 and an arithmetic logic unit, or ALU, 150. The timer 200 monitors the amount of time parked, i.e., the time interval between activation and deactivation of the device by a user, and any other pertinent time intervals in the system. Upon termination of a parking session, the time remaining is provided to an appropriate register (TIME REMAINING register 210, referred to below) in any known manner. It is recognized that multiple clocks may also be used. The ALU 150 performs all arithmetic operations necessary for operation of the system.

The microcomputer 130 also includes the TIME REMAINING register 210, a REMAINING VALUE register 220, a TIME USED register 230, an AMOUNT USED register 240, and a BREAK TIME register 250. These registers, which are preferably included as a portion of the RAM 135, are used in conjunction with the accounting system and will be more particularly described with reference to FIG. 8.

Figure 7:
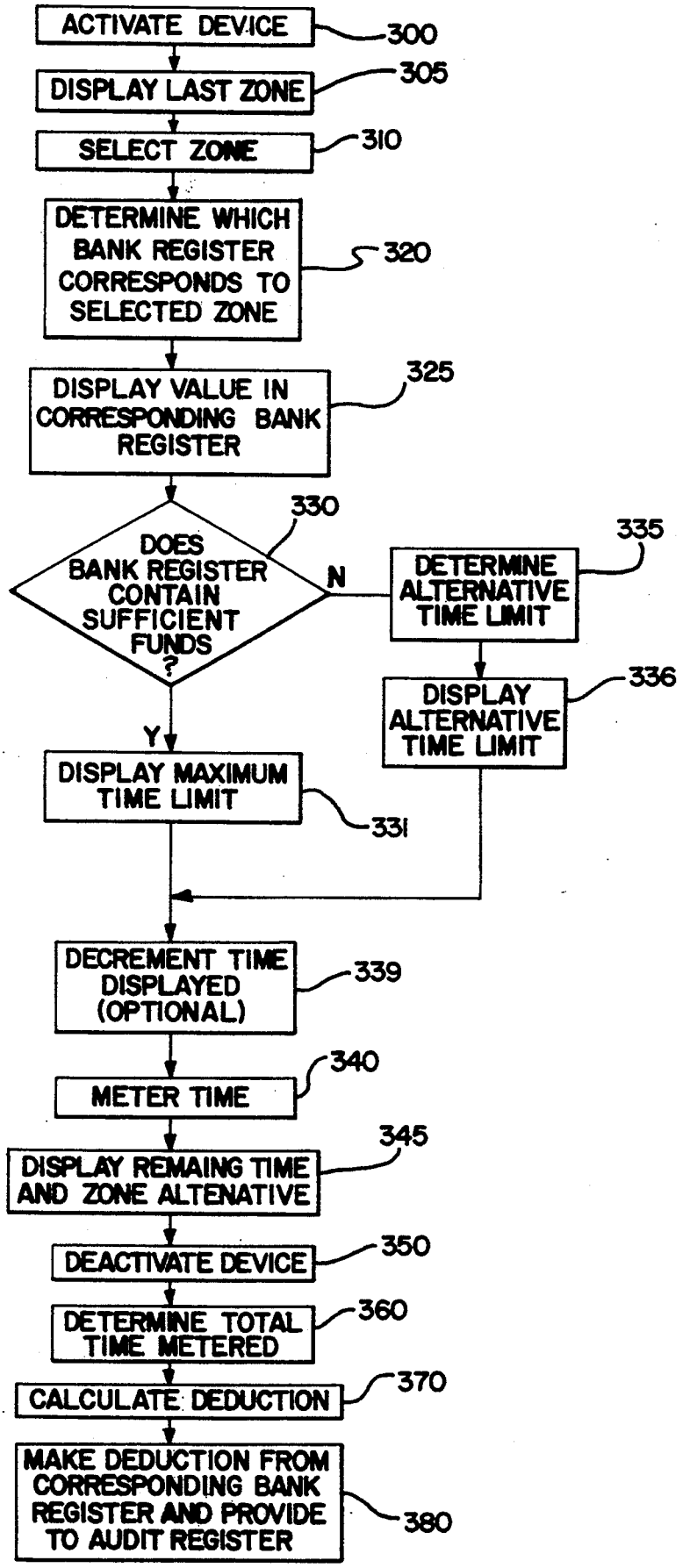
FIG. 7 is a flowchart representing a preferred operation of the metering device of FIG. 1.

In operation, as shown in FIG. 7 and with reference to FIGS. 2, 4, 5 and 6(*a*) and (*b*), a user activates the device 10 (step 300) by pressing the on/off key 60 which, in turn, engages the on/off switch 160 in an "on" (closed) position. The last zone for which a monetary value was deducted in a prior parking session is displayed on the display 40 (step 305). The zone indicated on the display 40 is changed using the increment key 70 and decrement key 80. Consequently, the increment switch 170 and decrement switch 180 are activated. Once a desired parking zone is displayed on the display 40, the confirm key 90 is pressed, engaging the switch 190, to select the desired zone (step 310).

The microcomputer 130 then determines which bank register (0–3) 131–134 corresponds to the selected zone (step 320). Reference is made to the zone data storage 144 to accomplish this operation. The value stored in the bank register corresponding to the selected zone is then displayed (step 325).

Next, the microcomputer 130 undergoes an initial accounting using an accounting system to determine if the corresponding bank register has sufficient funds stored therein to accommodate the maximum time limit for the selected zone (step 330). If sufficient funds exist in the corresponding bank register, then the maximum time limit, retrieved from the time limit table 142, is displayed (step 331) on the display 40. If insufficient funds exist, an alternate time limit corresponding to an amount of available funds is determined (step 335) and displayed (step 336). The initial accounting will be more particularly described with reference to FIG. 8.

Once either the maximum time limit or the alternative time is displayed, the displayed time may be decremented using the decrement key 80 (step 339). When an acceptable time is displayed, the user presses the confirm key 90 to begin metering the parking time (step 340).

During the parking time, the display 40 alternates between time remaining, as monitored by timer 200, and the selected zone (step 345). Such displaying technique allows a parking attendant to verify that the car is legally parked. It is to be recognized that numerous other verification techniques are possible, such techniques manipulating the display 40 in a variety of ways. For example, identification codes for the user and the device could be displayed and verified by the parking attendant.

If the user returns to the vehicle and deactivates the device 10 by pressing the on/off key 60 before the time runs down to zero (step 350), or the time actually runs down to zero, the original time less the remaining time, as monitored by the timer 200, is used to determine a total time metered, or parked (step 360). In accordance with the system of FIG. 8, charges are then calculated (step 370) and deducted from the corresponding bank register (0–3) 131–134 (step 380) as supervised by the microcomputer 130 and using the double split rate structure. The deduction is also provided to the audit register 136.

Figure 8:
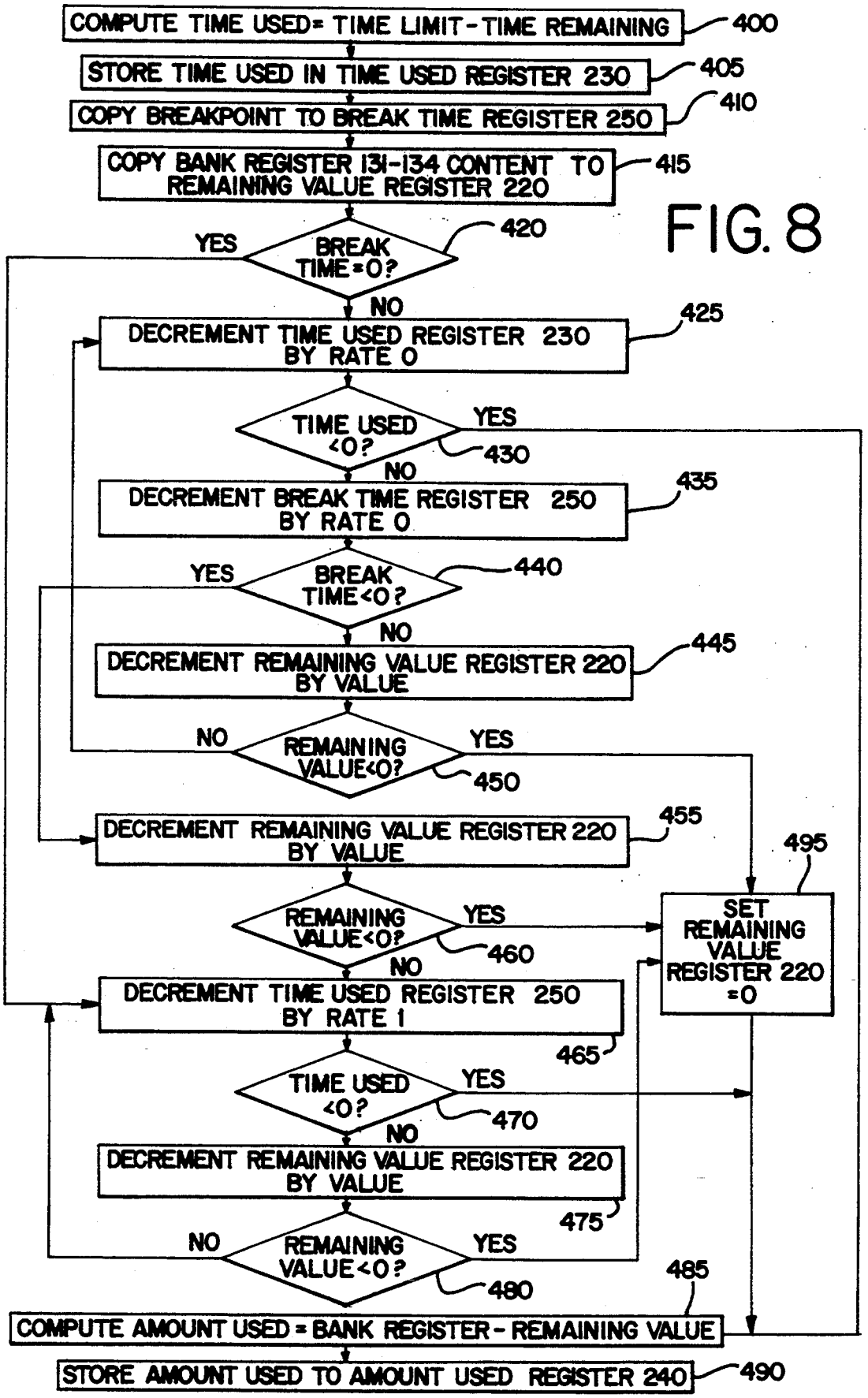
FIG. 8 is a flowchart representing the accounting system of the microcomputer of FIG. 5.
Figure 10:
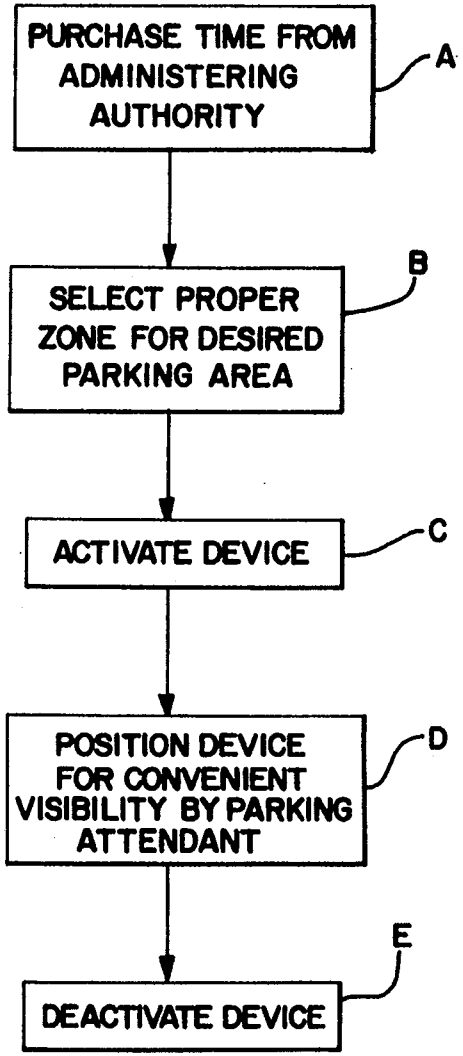

The accounting system implemented by microcomputer 130 and illustrated in FIG. 8 is applied initially to determine if sufficient funds exist in a particular bank register and subsequently at the termination of a parking session, i.e., when device turn off occurs with the time remaining at either 0 (automatic turn off), or when some residual amount of time remains (manual turn off). Application of the accounting system is substantially identical whether initially applied to determine if sufficient funds exist or applied to calculate a deduction from a bank register. The differences will be described in greater detail and by way of example hereinafter. At this point, the general flow of the accounting system will be described.

It is appreciated that the accounting system is preferably an instruction set stored in the ROM 139 of the microcomputer 130, as would be appreciated by those skilled in the art. Further recognized, however, is the adaptability of the accounting system to a suitable hardware configuration.

When a user selects a particular zone, a TIME LIMIT, a corresponding bank register, a VALUE, a BREAKPOINT TIME, and two rate values, RATE 0 and RATE 1 are specified by reference to appropriate tables 141–144, as shown in FIGS. 6(*a*) and (*b*). The accounting system utilizes internal read/write memory registers TIME REMAINING 210, REMAINING VALUE 220, TIME USED 230, AMOUNT USED 240, and BREAK TIME 250, all shown in FIG. 5, to facilitate convenient computation in an efficient manner. Accordingly, any reference made herein to contents of the registers may necessarily imply reference to the registers themselves. Additionally, all computations are accomplished by the ALU 150.

As shown in FIG. 8, the accounting system includes computation of the total time parked, or used, by determining the difference between the TIME LIMIT and the TIME REMAINING, determined by the timer 200, at deactivation (step 400). This value is then stored in the TIME USED register 230 (step 405). The breakpoint for this zone is then copied from the table 143 to the BREAK TIME register 250 (step 410). Likewise, the bank register value for this zone is copied to the REMAINING VALUE register 220 (step 415).

If BREAK TIME is 0 then there is no need to calculate a split rate for this zone (step 420). Therefore, only RATE 1 is used beginning with step 465. If a split rate structure is designated, however, the deduction for RATE 0 up to the BREAK TIME is calculated. Specifically, the TIME USED register 230 is decremented by RATE 0 (step 425). A determination is then made whether TIME USED is less than 0 (step 430). If TIME USED is less than 0, the AMOUNT USED is then calculated (step 485) and stored (step 490). If TIME USED is not less than 0, the BREAK TIME register 250 is decremented by RATE 0 (step 435). A determination is then made whether BREAK TIME is less than 0 (step 440). If BREAK TIME is less than 0, the deduction for RATE 1 is then calculated beginning at step 455. If, however, the BREAK TIME is not less than zero, the REMAINING VALUE register 220 is decremented by VALUE (step 445). It is then determined whether the REMAINING VALUE is less than 0 (step 450). If not, steps 425–450 are repeated. If the REMAINING VALUE is less than 0, the REMAINING VALUE is set to zero and the AMOUNT USED is calculated (step 485) and stored (step 490).

The deduction based on RATE 1 is calculated using steps 455–480. Specifically, the REMAINING VALUE register 220 is decremented by VALUE if the determination in step 440 is made that BREAK TIME is less than 0 (step 455). Then, a determination is made whether REMAINING VALUE is less than 0 (step 460). If the REMAINING VALUE is less than 0, the REMAINING VALUE is set to 0 (step 495) and the AMOUNT USED is calculated (step 485) and stored (step 490). If the REMAINING VALUE is not less than 0, the TIME USED register 230 is decremented by RATE 1 (step 465). It is then determined whether TIME USED is less than 0 (step 470). If TIME USED is less than 0, the AMOUNT USED is calculated (step 485) and stored (step 490). If TIME USED is not less than 0, the REMAINING VALUE register 220 is decremented by VALUE (step 475). A determination is then made whether the REMAINING VALUE is less than 0 (step 480). If not, steps 465–480 are repeated. If the REMAINING VALUE is less than 0, the REMAINING VALUE is set equal to 0 (step 495) and the AMOUNT USED is computed (step 485) and stored (step 490).

As noted above, differences exist in the application of the accounting system depending on whether the system is being initially applied to determine if sufficient funds exist or to calculate an actual deduction from a bank register (0–3) 131–134. First, the initial accounting to determine if sufficient funds exist begins with TIME REMAINING=0 instead of with an actual metered time result. Accordingly, after application of the accounting system, it is appreciated that the TIME USED will be a value less than zero if the corresponding bank register (0–3) 131–134 contains sufficient funds to cover the maximum TIME LIMIT. Conversely, the TIME USED will be greater than zero if the corresponding bank register has insufficient funds. If sufficient funds are available, the device 10 starts the parking time at the maximum TIME LIMIT. If not, the parking time is set to the TIME LIMIT—TIME USED. In either case, the time limit is displayed on the display 40.

For example, assume a user has $10.00 stored in bank register (1) 132. If the user selects zone 6, the following data is specified, as shown in FIGS. 6(*a*) and (*b*): VALUE=1 penny, BREAKPOINT=2 hrs., TIME LIMIT=6 hrs., RATE 0=72 seconds, RATE 1=36 seconds, BANK #=bank register (1) 132. In view of the results of equations (1) and (2) above, it is appreciated that $5.00 is required to park the maximum time in zone 6.

Initially, referring to FIG. 8, TIME USED=TIME LIMIT since TIME REMAINING is set to zero. TIME USED is then calculated as being 6 hours (step 400) and stored (step 405). The BREAKPOINT of 2 hours is stored in BREAKTIME register 250 (step 410). The REMAINING VALUE register 220 is provided with data representing $10.00 (step 415).

In the first iteration through the accounting steps, it is apparent that since BREAKTIME, TIME USED, and REMAINING VALUE remain greater than zero after decrementation (steps 425, 435, 445), the second iteration begins at step 425. The remaining iterations will not be specifically described since one skilled in the art could easily follow the steps to reach the correct results.

However, it is recognized that, in this instance, since $5.00 is needed to park in zone 6 for the maximum time of 6 hours, and $10.00 is stored in the REMAINING VALUE register 220, the REMAINING VALUE will not decrease below zero. Further, since the TIME USED is greater than BREAKTIME, the determination at step 440 will, at some point, send the procedure to step 455. Subsequently, TIME USED becomes less than zero (step 470) upon completion of the whole procedure and the maximum time limit of 6 hours is displayed.

Now, assuming that $0.50 is initially stored in bank register (1) 132, it can be appreciated that completion of the accounting procedure results in REMAINING VALUE being determined negative at step 450. At that point, TIME USED has been decremented but is still a positive value so the time limit displayed is TIME LIMIT—TIME USED. It is recognized that because TIME USED is decremented before REMAINING VALUE, an additional increment of parking time may be given to a user. However, for long term metering purpose, this additional increment of parking time is considered negligible.

A second major difference between the accounting system as initially applied and as applied when a deduction is calculated is that when an actual deduction is calculated, AMOUNT USED is effectively deducted by the microcomputer 130 from the corresponding bank register (0–3) 131–134 by simply rewriting the contents of the REMAINING VALUE register 220 into the appropriate bank register (0–3) 131–134. However, it is recognized that other mathematical manipulation of the data may be accomplished to deduct funds. AMOUNT USED is also provided to audit register 136. Otherwise, if the accounting system of FIG. 8 is being used to determine if sufficient funds exist in a particular bank, no deductions are made and the appropriate time limit is displayed on the display 40.

For example, assuming again that $10.00 exists in the bank register (1) 132, if a user selects zone 6 and parks for 1 hour, the user will be charged $0.50. The $0.50 will ultimately be deducted from the bank register (1) 132, leaving $9.50, and provided to the audit register 136, contributing to the total represented therein by $0.50.

It is appreciated that variations in the accounting system may occur if a user exceeds the allowed parking time in a selected zone. For example, a penalty rate may be used for excessive parking time. A table storing selectively scaled penalty rates may be provided and accessed to penalize a user for the amount of time overparked.

Figure 9:
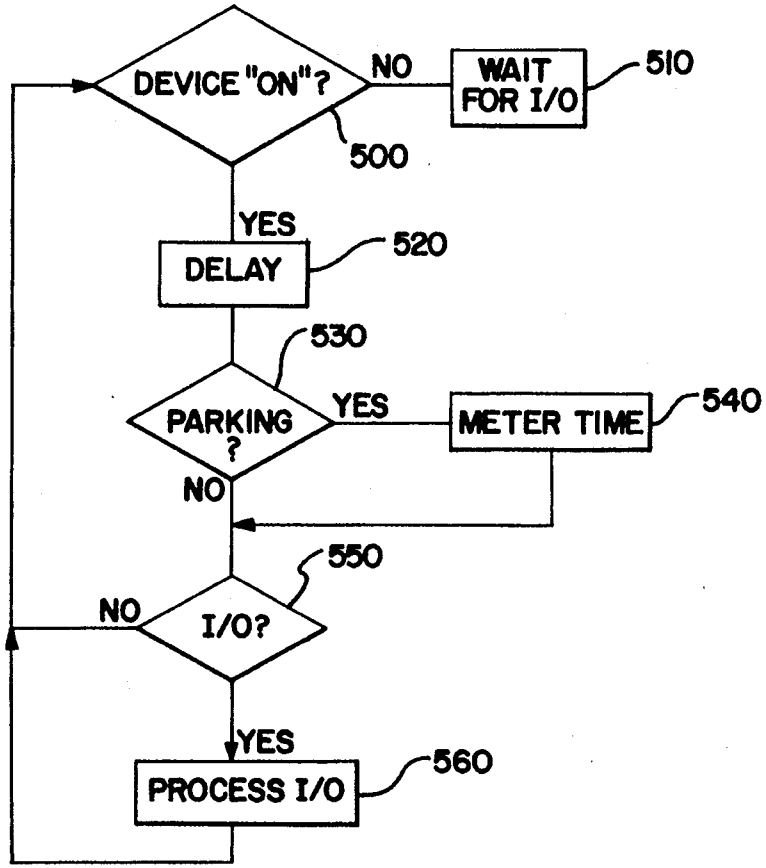
FIG. 9 is a flowchart representing the control flow of the device of FIG. 1; and, FIG. 10 is a flowchart representing a general overview of a user's actions in an in-car parking meter system.

FIG. 9 illustrates the control flow of the device 10, preferably stored in ROM 139. Specifically, the microcomputer 130 first determines whether it is "on" (step 500). If not, a wait state is implemented to wait for input/output for activation (step 510). At this point, essentially no power is consumed. If the device is "on", a 0.25 second delay is utilized (step 520) to consume very little power. If the device 10 is being used during a parking session, time is metered (steps 530 and 540). If not, time is not metered. In either case, though, it is determined whether any input or output information (I/O) has been received or transmitted (step 550). The input or output information may be a result of activation of the switches 160, 170, 180, 190 engaged by the keys 60, 70, 80, 90 of the control panel 50 or serial data input or output through the communication transceiver 110. Appropriate switch processing or serial processing i.e., auditing, loading, verification, is then accomplished (step 560) and the control flow is returned to step 500. If no input/output is detected, the control flow is simply returned to step 500.

The description has been principally directed to a preferred embodiment of the invention. However, it is recognized that numerous variations of the invention may be implemented.

For example, in the case where a user exceeds the maximum time limit for a particular zone and a penalty rate may be assessed, the device 10 may be designed to make a deduction from the corresponding bank register when the metered time runs to zero and another deduction when the device is deactivated, the second deduction accounting for any penalty which may be assessed against the user.

Additionally, as noted above, it is advantageous that the parking attendant have the ability to independently verify that a particular in-car parking meter is legally, or validly, metering time. Such verification may more particularly be accomplished through an exchange of verification information between a hand-held remote device provided to the parking attendant and the in-car parking meter via the communication transceiver. Use of a hand-held remote device provides improved accuracy and efficiency for the parking meter system.

A value decrement option may be implemented in the device 10. Such feature would cause an amount deducted to be rounded up even if only a single second of metered time extends beyond a time increment, or rate. Obviously, rounding up the deduction in this manner would benefit the administering authority.

Moreover, it is appreciated that funds due for parking may be purchased on a retroactive basis instead of a prospective basis, as in the preferred embodiment. Prepurchasing obviously benefits the administering authority and assures that parking time is actually paid for by the user. However, a system is contemplated where parking time is merely monitored and actual payment tendered to the administering authority based on the monitored parking time.

The above description merely provides a disclosure of particular embodiments of the invention and is not intended for the purpose of limiting the same thereto. As such, the invention is not limited to only the above described embodiments. Rather, it is recognized that one skilled in the art could conceive alternative embodiments that fall within the scope of the invention.

Having thus described the invention, I claim:

1. A time metering device useful as an in-car parking meter for metering parking time in any one of a plurality of zones, the device comprising:

a plurality of bank registers, each bank register having stored therein a monetary value and each of the plurality of zones corresponding to a one bank register;

means for selectively determining whether a sufficient monetary value is stored in a corresponding bank register of a selected zone to allow parking in the selected zone for a specified amount of time;

means for selectively determining a total amount of the specified amount of time parked in the selected zone; and, means for deducting from the monetary value of the corresponding bank register in accordance with the total amount of the time parked.

2. The device according to claim 1 further comprising a communication transceiver selectively coupled to the plurality of bank registers.

3. The device according to claim 2 wherein the communication transceiver includes means for facilitating input of the monetary value in the each bank register.

4. The device according to claim 1 further comprising an audit register selectively coupled to the deducting means for storing therein deductions cumulatively.

5. The device according to claim 4 wherein the deducting means includes means for inputting deductions to the audit register.

6. The device according to claim 1 further comprising a means for selectively displaying the monetary value, the selected zone, and the time parked.

7. The device of claim 1 wherein the means for selectively determining whether a sufficient monetary value is stored in a corresponding bank register of a selected zone to allow parking in the selected zone includes means for determining based on stored information.

8. The device according to claim 7 wherein the stored information comprises data tables.

9. A device comprising:

a microprocessor including:

a plurality of bank registers, each bank register having stored therein a monetary value and corresponding to at least one of a plurality of parking zones, each parking zone corresponding to one bank register, means for selectively determining whether a sufficient monetary value is stored in a corresponding bank register of a selected zone to allow parking in the selected zone for a specified amount of time, means for metering the specified amount of time in the selected zone;

means for selectively determining a total time parked in the selected zone based on metered time, means for calculating a deduction value based on the total time parked, the selected zone, and means for deducting the deduction value from the monetary value;

means for selectively displaying the monetary value, the selected zone and the metered time; and, means for communicating with the microprocessor to facilitate input of monetary values to the plurality of bank registers.

10. The device of claim 9 wherein the means for selectively determining whether a sufficient monetary value is stored in a corresponding bank register of a selected zone to allow parking in the selected zone includes means for determining based on stored information.

11. The device according to claim 10 wherein the stored information comprises data tables.

12. The device according to claim 10 wherein the communicating means includes means for facilitating loading and altering the stored information.

13. A time metering device useful for metering parking time in any one of a plurality of zones, the device comprising:

a plurality of bank registers, each bank register having stored therein a monetary value and corresponding to at least one of a plurality of parking zones, each parking zone corresponding to only one bank register;

means for selecting a zone;

means for determining which of the plurality of bank registers corresponds to the selected zone;

means for determining a maximum time limit for the selected zone;

means for determining whether the corresponding bank register has a sufficient monetary value stored therein to accommodate the maximum time limit;

means for determining an alternative time limit if the monetary value is not sufficient to accommodate the maximum time limit;

means for decrementing one of the maximum time limit and the alternative time limit to obtain a desired time limit;

means for metering time based on the desired time limit;

means for determining a total time parked based on the metered time;

means for calculating a deduction value based on the total time parked;

means for deducting the deduction value from the monetary value of the corresponding bank register.

14. The device according to claim 13 further comprising a communication transceiver selectively coupled to the plurality of bank registers.

15. The device according to claim 14 wherein the communication transceiver includes means for facilitating input of the monetary value in the each bank register.

16. The device according to claim 13 further comprising means for selectively displaying the monetary value, the selected zone, and the metered time.

17. A time metering device useful for metering parking time in any one of a plurality of zones, the device comprising:

a plurality of bank registers, each bank register having stored therein a monetary value and corresponding to at least one of a plurality of parking zones, each parking zone corresponding to only one bank register;

means for selecting a zone;

means for determining which of the plurality of bank registers corresponds to the selected zone in accordance with stored information;

means for determining a maximum time limit for the selected zone in accordance with stored information;

means for determining whether the corresponding bank register has a sufficient monetary value stored therein to accommodate the maximum time limit in accordance with the stored information;

means for determining an alternative time limit if the monetary value is not sufficient to accommodate the maximum time limit in accordance with the stored information;

means for decrementing one of the maximum time limit and the alternative time limit to obtain a desired time limit;

means for metering time based on the desired time limit;

means for determining a total time parked based on the metered time;

means for calculating a deduction value based on the total time parked, the selected zone and the stored information;

means for deducting the deduction value from the monetary value of the corresponding bank register.

18. The device according to claim 17 wherein the stored information comprises data tables.

19. A time metering device useful for metering parking time in any one of a plurality of zones, the device comprising:

a microcomputer including a plurality of bank registers, each bank register having stored therein a monetary value and corresponding to at least one of a plurality of parking zones, each parking zone corresponding to only one bank register, means for selecting a zone, means for determining which of the plurality of bank registers corresponds to the selected zone, means for determining a maximum time limit for the selected zone, means for determining whether the corresponding bank register has a sufficient monetary value stored therein to accommodate the maximum time limit, means for determining an alternative time limit if the monetary value is not sufficient to accommodate the maximum time limit, means for decrementing one of the maximum time limit and the alternative time limit to obtain a desired time limit, means for metering time based on the desired time limit, means for determining a total time parked based on the metered time, means for calculating a deduction value based on the total time parked, and means for deducting the deduction value from the monetary value of the corresponding bank register;

a display for selectively displaying the selected zone, the maximum time limit, the alternative time limit, the monetary value, and the metered time; and, a communication transceiver for inputting the monetary value in the each bank register.

20. A method of time metering for use in a system including a plurality of bank registers, each bank register having stored therein a monetary value and corresponding to only one of a plurality of parking zones, and a storage means having information stored therein, the method comprising steps of:

selecting a zone;

determining which of the plurality of bank registers corresponds to the selected zone in accordance with the stored information;

determining a maximum time limit for the selected zone in accordance with the stored information;

determining whether the corresponding bank register has a sufficient monetary value stored therein to accommodate the maximum time limit in accordance with the stored information;

determining an alternative time limit if the monetary value is not sufficient to accommodate the maximum time limit in accordance with the stored information;

decrementing one of the maximum time limit and the alternative time limit to obtain a desired time limit;

metering time based on the desired time limit;

determining a total time parked based on the metered time;

calculating a deduction value based on the total time parked, the selected zone and the stored information; and, deducting the deduction value from the monetary value of the corresponding bank register.

* * * * *